US006089693A

United States Patent [19]

Drake et al.

[11] Patent Number: 6,089,693

[45] Date of Patent: Jul. 18, 2000

[54] PAGEWIDTH INK JET PRINTER INCLUDING MULTIPLE PASS DEFECTIVE NOZZLE CORRECTION

[75] Inventors: Donald J. Drake, Rochester; Frederick A. Donahue, Walworth, both of N.Y.

[73] Assignee: Xerox Corporation, Stamford, Conn.

[21] Appl. No.: 09/004,553

[22] Filed: Jan. 8, 1998

[51] Int. Cl.[7] ..... B41J 29/393; B41J 29/38; B41J 2/165; B41J 2/155

[52] U.S. Cl. ..... 347/19; 349/14; 349/13; 349/23; 349/42

[58] Field of Search ..... 347/9, 19, 42, 347/12, 13, 23

[56] References Cited

U.S. PATENT DOCUMENTS

| | | | |
|---|---|---|---|
| 4,748,453 | 5/1988 | Lin et al. | 347/41 |
| 5,057,854 | 10/1991 | Pond et al. | 347/42 |
| 5,160,945 | 11/1992 | Drake | 347/42 |
| 5,216,442 | 6/1993 | Parks et al. | 346/134 |
| 5,300,957 | 4/1994 | Burke | 347/41 |
| 5,398,053 | 3/1995 | Hirosawa et al. | 347/13 |
| 5,572,244 | 11/1996 | Drake et al. | 347/42 |
| 5,587,730 | 12/1996 | Karz | 347/13 |
| 5,627,571 | 5/1997 | Anderson et al. | 347/19 |
| 5,798,773 | 8/1998 | Hiramatsu et al. | 347/19 |

*Primary Examiner*—Juanita Stephens

[57] ABSTRACT

A liquid ink printer, depositing ink drops to form an image, including a pagewidth printbar, movable to print a complete image when defective nozzles of the printbar are identified. A positioning device, coupled to the pagewidth printbar, positions the printbar at a plurality of discrete locations, to move a functioning nozzle to the location in the image where the defective nozzle should deposit drops of ink. Defective nozzles are identified by the printer control mechanism and a user is given the option to fix the image through a user interface where the printer is directed to fill in the missing information of the image. Defective nozzles can also be identified by printing a test pattern which identifies to a user which of the nozzles are non-functioning. The user then inputs this information to the printer.

16 Claims, 4 Drawing Sheets

PAGEWIDTH INK JET PRINTER INCLUDING MULTIPLE PASS DEFECTIVE NOZZLE CORRECTION

RELATED APPLICATIONS

Cross-reference is made to patent application No. 09/004,826, filed Jan. 8, 1998, entitled "An lnkjet Marking Device Including a Positionable Printbar to Improve Image Output", to William G. Hawkins et al. filed concurrently herewith, herein incorporated by reference.

FIELD OF THE INVENTION

This invention relates generally an ink jet printer and more particularly to a pagewidth ink jet printer including multiple pass defective nozzle correction.

BACKGROUND OF THE INVENTION

Liquid ink printers of the type frequently referred to as continuous stream or as drop-on-demand, such as piezoelectric, acoustic, phase change wax-based or thermal, have at least one printhead from which droplets of ink are directed towards a recording medium. Within the printhead, the ink is contained in a plurality of channels. Power pulses cause the droplets of ink to be expelled as required from orifices or nozzles at the end of the channels.

In a thermal ink-jet printer, the power pulse is usually produced by a heater transducer or a resistor, typically associated with one of the channels. Each resistor is individually addressable to heat and vaporize ink in the channels. As voltage is applied across a selected resistor, a vapor bubble grows in the associated channel and initially bulges from the channel orifice followed by collapse of the bubble. The ink within the channel then retracts and separates from the bulging ink thereby forming a droplet moving in a direction away from the channel orifice and towards the recording medium whereupon hitting the recording medium a drop or spot of ink is deposited. The channel is then refilled by capillary action, which, in turn, draws ink from a supply container of liquid ink.

The ink jet printhead may be incorporated into either a carriage type printer, a partial width array type printer, or a page-width type printer. The carriage type printer typically has a relatively small printhead containing the ink channels and nozzles. The printhead can be sealingly attached to a disposable ink supply cartridge. The combined printhead and cartridge assembly is attached to a carriage which is reciprocated to print one swath of information (having a height equal to the length of a column of nozzles), at a time, on a stationary recording medium, such as paper or a transparency. After the swath is printed, the paper is stepped a distance equal to the height of the printed swath or a portion thereof, so that the next printed swath is contiguous or overlapping therewith. This procedure is repeated until the entire page is printed. In contrast, the page width printer includes a stationary printhead having a length sufficient to print across the width or length of a sheet of recording medium at a time. The recording medium is continually moved past the page width printhead in a direction substantially normal to the printhead length and at a constant or varying speed during the printing process. A page width ink-jet printer is described, for instance, in U.S. Pat. No. 5,192,959.

Various printers and methods are illustrated and described in the following disclosures which may be relevant to certain aspects of the present invention.

In U.S. Pat. No. 4,748,453 to Lin et al., a method of depositing spots of liquid ink on a substrate is described. A line of information is printed in at least two passes so as to deposit spots of liquid ink on selected pixel centers in a checkerboard pattern wherein only diagonally adjacent pixel areas are deposited in the same pass.

U.S. Pat. No. 5,057,854 to Pond et al. describes modular partial bars and full width array printheads fabricated from modular partial bars. The modular partial bars include a substrate bar having a length and a plurality of printhead subunits attached to only one side of the substrate bar. The modular partial bars are used as building blocks to form full width staggered array printheads.

U.S. Pat. No. 5,160,945 to Drake describes a page width thermal ink jet printhead for an ink jet printer. The printhead is of the type assembled from fully functional roof shooter type printhead subunits.

U.S. Pat. No. 5,216,442 to Parks et al. describes an ink jet printer having a platen with a planar surface sized to hold a sheet. The platen is movably mounted for linear reciprocal movement between a sheet receiving position and a sheet releasing position.

U.S. Pat. No. 5,300,957 to Burke describes a method and apparatus for high speed interlaced printing in the direction of printhead scanning. A cylindrical drum is rotatable about a drum axis for supporting a print medium during printing. The drum is rotated about the drum axis at a predetermined speed such that alternate image-element locations are addressed by each printing element during each rotation of the drum at the predetermined rate. The drum rotates two revolutions at each printhead location along with access and all image element locations are addressed.

U.S. Pat. No. 5,398,053 to Hirosawa et al. describes a line type recording head and a serial type recording head movable in the arrangement direction of the line type recording head orifices. The serial type recording head compensates for any improperly recording orifices of the line type recording head.

U.S. Pat. No. 5,572,244 to Drake et al. describes a large array or page width printhead fabricated from printhead elements or subunits having adhesive-free butting edges. Each of the printhead elements includes a heater element and a channel element bonded together by an adhesive such as an epoxy.

SUMMARY OF THE INVENTION

In accordance with one aspect of the present invention, there is provided a liquid ink printer, depositing ink drops to form an image responsive to image data, on a recording medium moving along a recording medium path. The printer includes a pagewidth printbar, including an array of ink ejecting nozzles, aligned substantially perpendicular to the recording medium path, to eject the ink drops on the recording medium during movement of the recording medium along the recording medium path, a nozzle identification circuit, coupled to the pagewidth printbar, to generate a detection signal indicative of the operation of the array of ink ejecting nozzles, a positioning device, coupled to the pagewidth printbar, to position the pagewidth printbar at a plurality of discrete locations, and a controller, coupled to the positioning device and to the nozzle identification circuit, to cause the positioning device to position the printbar at one of the plurality of discrete locations as a function of said detection signal.

In accordance with another aspect of the present invention, there is provided a method for printing an image, with a pagewidth printbar, including one or more non-functioning nozzles and a plurality of functioning nozzles depositing liquid ink on a recording medium moving along a path. The method includes the steps of identifying one of the plurality of nozzles which is non-functioning, printing a portion of the image with the plurality of functioning nozzles with the printbar located at a first position, moving the printbar substantially perpendicular to the path to a second position, and printing another portion of the image with one of the plurality of functioning nozzles.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
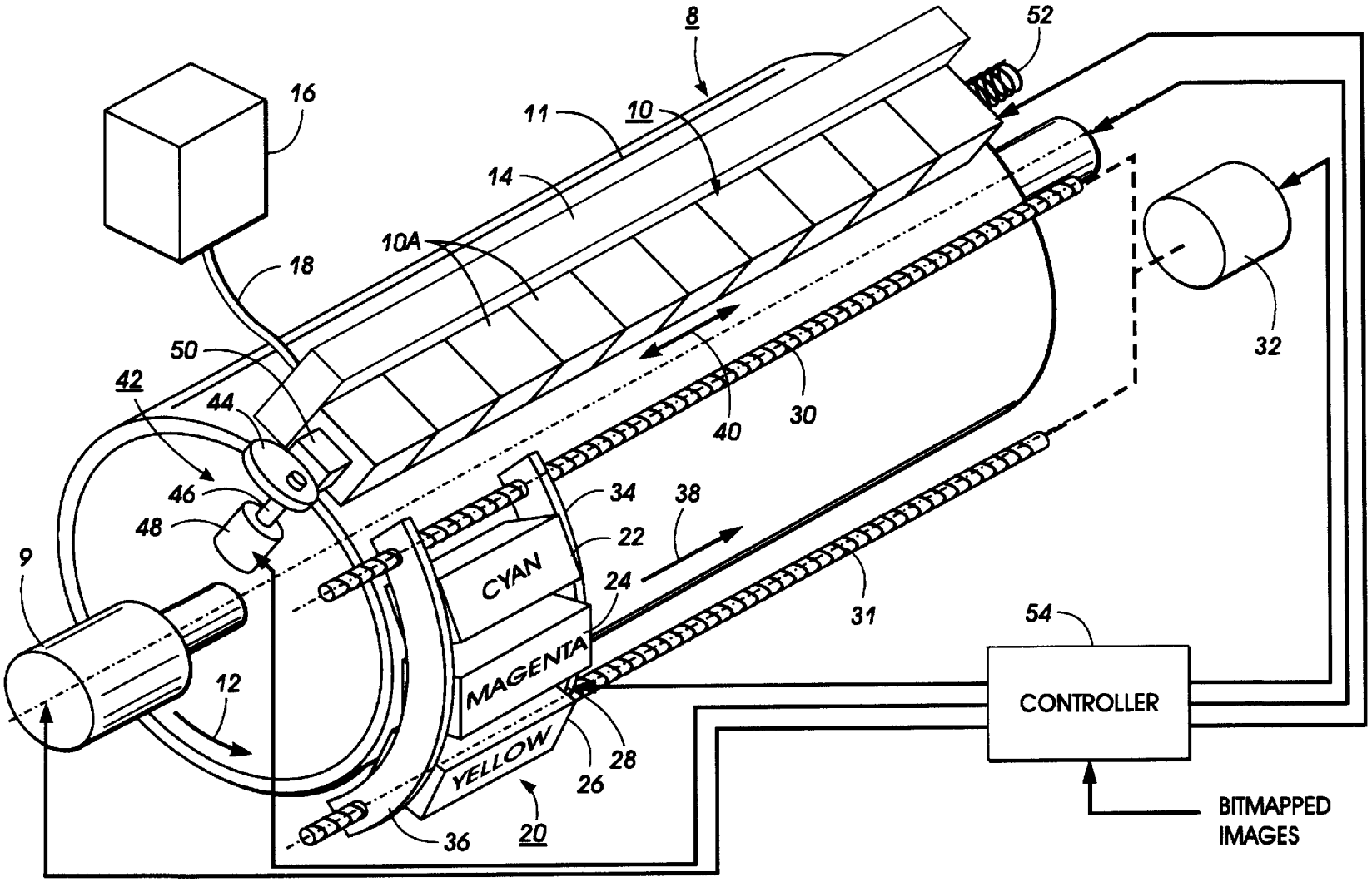
FIG. 1 is a perspective view of an ink jet printer of the present invention.

FIG. 1 illustrates one embodiment of the present invention of a ink jet printer 8 including a pagewidth or large array black print bar 10 positioned to deposit ink on a curved recording medium placed on a rotating drum 11 which is rotated by a multiple speed motor 9 and which rotates the drum 11 in the direction of an arrow 12 at selected different speeds. The print bar 10 has been assembled from a plurality of modules or printhead dies 10A which are butted together to form an extended width array according to the techniques described, for example, in U.S. Pat. No. 5,221,397 the contents of which are hereby incorporated by reference. In this example, the print bar 10 includes 7,200 nozzles or jets. As described in the '397 patent, the printhead dies 10A are formed by mating a channel die containing arrays or recesses that are used as channels for delivering ink and associated ink reservoirs and a heater die containing heater elements and the appropriate addressing circuitry. The mated channel die and heater die form the printhead die which are butted together to form the print bar. The heater elements are selectively energized to heat the ink contained within a channel to expel an ink droplet from the associated nozzle. The ink channels are coupled into a common ink manifold 14 mounted along and attached to the print bar 10 in sealed communication with the ink inlets of the channel dies through aligned openings. The manifold 14 is supplied with the appropriate ink, black in this example, from an ink container 16 through a flexible tubing 18 attached thereto.

In addition to the print bar 10 printing black ink, a color printhead assembly 20 includes a plurality of ink jet printheads 22, 24, and 26, each printing a respective color, for instance cyan, magenta, and yellow. The appropriate ink can be supplied to the associated printhead by inclusion in an attached printhead ink tank coupled to the printheads themselves or by ink containers attached to the printheads through flexible tubing (not shown) such as illustrated by the ink container 16. The assembly 20 is mounted on a translatable carriage 28 which is driven by lead screws 30 and 31 by a drive motor 32. The carriage 28 includes curved frame members 34 and 36, portions of which include threaded apertures through which the lead screws 30 and 31 are threaded. The carriage 28 moves in a direction 38. The printheads 22, 24 and 26 are conventional in construction and can be fabricated, for example, as illustrated in U.S. Pat. Re. Nos. 32,572 and 4,774,530 both of which are incorporated by reference.

While the printer of FIG. 1 can be operated either as a black only printer by printing with the print bar 10 only or as a color printer by using the assembly 20 to deposit colored inks or a combination of the two, the printer of FIG. 1 also includes an additional mechanism for improving the image output of the printer 10 by the use of a multiple pass printing technique whereby the print bar 10 is moved in discrete steps to enable printing complete images even if one or more of the printhead nozzles becomes defective.

The print bar 10 is moved in a direction 40 by a positioning device 42 which changes the position of the print bar 10 during each rotation of the drum 11. In one embodiment, the positioning device 42 includes a cam 44 rotating upon a spindle 46 which is driven by a motor 48. The cam 44 is eccentrically shaped and has an axis of rotation which is offset from the center of the cam such that when the cam 44 rotates upon a butting member 50, the print bar moves in the direction 40 an amount determined by the shape of the cam as well as the amount of rotation determined by the motor 48. A spring bias system 52 is located at the opposite end of the print bar such that the print bar 10 is maintained in a stable position during printing.

To print an image, a controller 54 receives bit map images from a print driver which is either resident in the printer or is resident in an image generating device such as a personal computer, or a combination of the two. The bit mapped images are manipulated by the controller 54 such that the appropriate signals are transmitted to the print bar 10 as well as the printhead assembly 20. The drive signals generated by the controller 54 are conventionally applied via wire bonds to drive circuitry and logic on each of the printhead dies 10A and each of the printheads 22, 24, and 26. Signals include pulsing signals which are applied to the heat generating resistors or transducers formed in the heater dies. The controller 54 may take the form of a microcomputer including a central processing unit, a read-only memory for storing complete programs and a random access memory. The controller 54 also controls other machine functions such as rotation of the drum 11, movement of the scanning carriage 28 by control of the motor 32 as well as movement of the print bar 10 in discrete locations determined by the rotation of the cam 44 under control of the motor 48.

Figure 2:
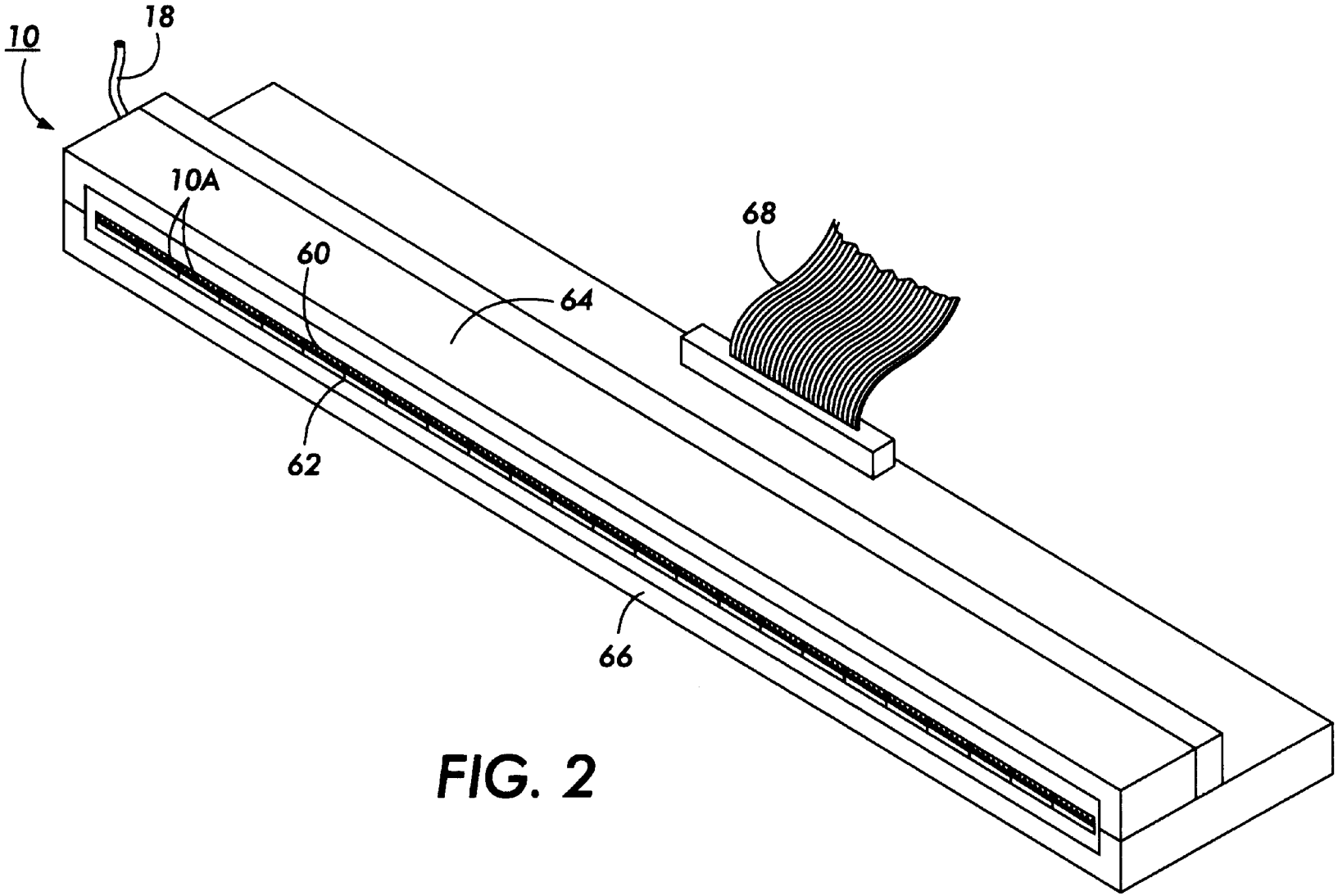
FIG. 2 is a perspective view of an ink jet printbar.

FIG. 2 illustrates a more detailed illustration of the print bar 10. As illustrated, the print bar 10 includes multiple printhead dies 10A as previously described each shown to include, for purposes of illustration, four printhead nozzles 60 having a fixed resolution, such as 600 nozzles per inch. More or less nozzles per inch are also possible. Each of the printhead dies 10A is butted to an adjacent printhead die and a printhead die joint 62 is located therebetween. The printhead dies are mounted between a first substrate 64 and a second substrate 66. Other configurations are also possible. A ribbon cable 68 is coupled to one of the substrates 66 and provides the signals to the various printhead dies received from the controller 54 as previously described.

Defects resulting from the failure of certain nozzles to eject ink during the printing process can generate images which are unacceptable. Such defects are considered a significant failure mode and can result in a user not printing with the printer until the non-printing nozzle is remedied either through a maintenance operation or by replacement of the printbar. While it is possible to reduce the impact of such defects by printing an image in a checkerboard fashion in multiple revolutions of the drum by moving the printbar 10 in the direction 40 by a discrete amount for each revolution, such a solution does not completely eliminate the objectionable defect of the non-printing nozzle. Even though the visibility of the non-printing nozzle is reduced, because a pixel line along the paper path direction is composed of ink drops from two separate nozzles, such a solution to the non-printing nozzle is still considered to be visible and therefore objectionable.

In view of such printing defects and the ineffectiveness of the completely hiding the problem by checkerboard printing, the present invention provides a solution to such a printing problem by detecting which of the nozzles are not printing, moving the printbar 10 in the direction 40 to align a properly functioning nozzle with the image defect produced by the non-printing nozzle, sending to the properly functioning nozzle the image information to fill in the missing image information, and printing the missing image information with the functioning nozzle. While such a solution may result in the an extra amount of time to complete the image by rotating the drum an extra one or more revolutions, the extra time is insignificant when balanced against a user's desire to continue printing until a defective nozzle can be fixed.

Figure 3:
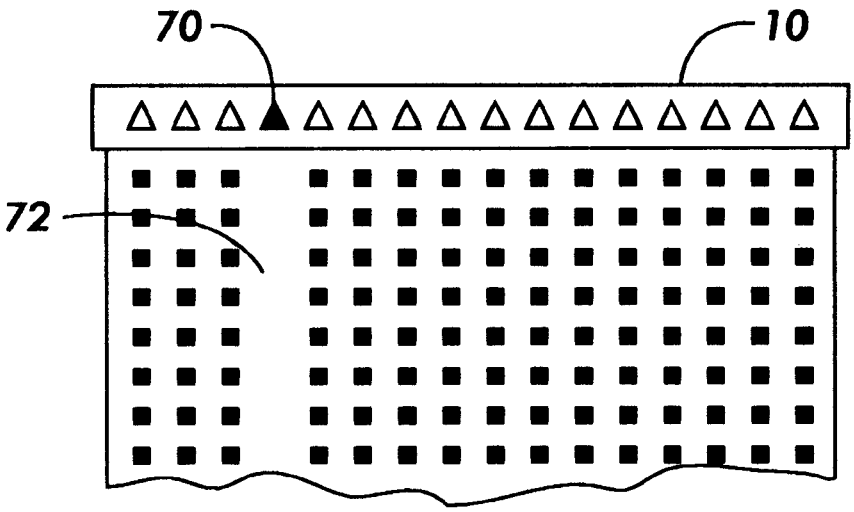
FIG. 3 is a schematic diagram of an image printed with a defective printbar nozzle.

FIG. 3 is a schematic diagram of the an example of the printbar 10 which includes a defective nozzle 70 which has failed to eject ink along a pixel line 72, (a column with respect to the direction 40) which is parallel to the moving direction of the recording medium.

Figure 4:
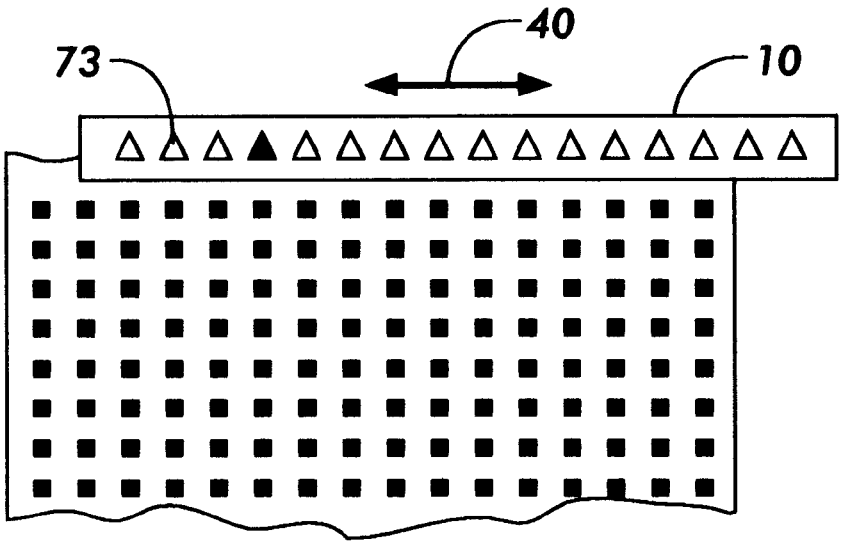
FIG. 4 is a schematic diagram of the image of FIG. 3 having the image corrected by printing with another nozzle of the printbar by movement thereof.

FIG. 4 is a schematic diagram of the improved printing output of the printbar 10 when the printbar 10 is moved in the direction 40 to thereby move and align a functioning nozzle 73 with the pixel line 72 to thereby fill in the printing locations which have not been deposited with ink due to the defective nozzle 70.

Figure 5:
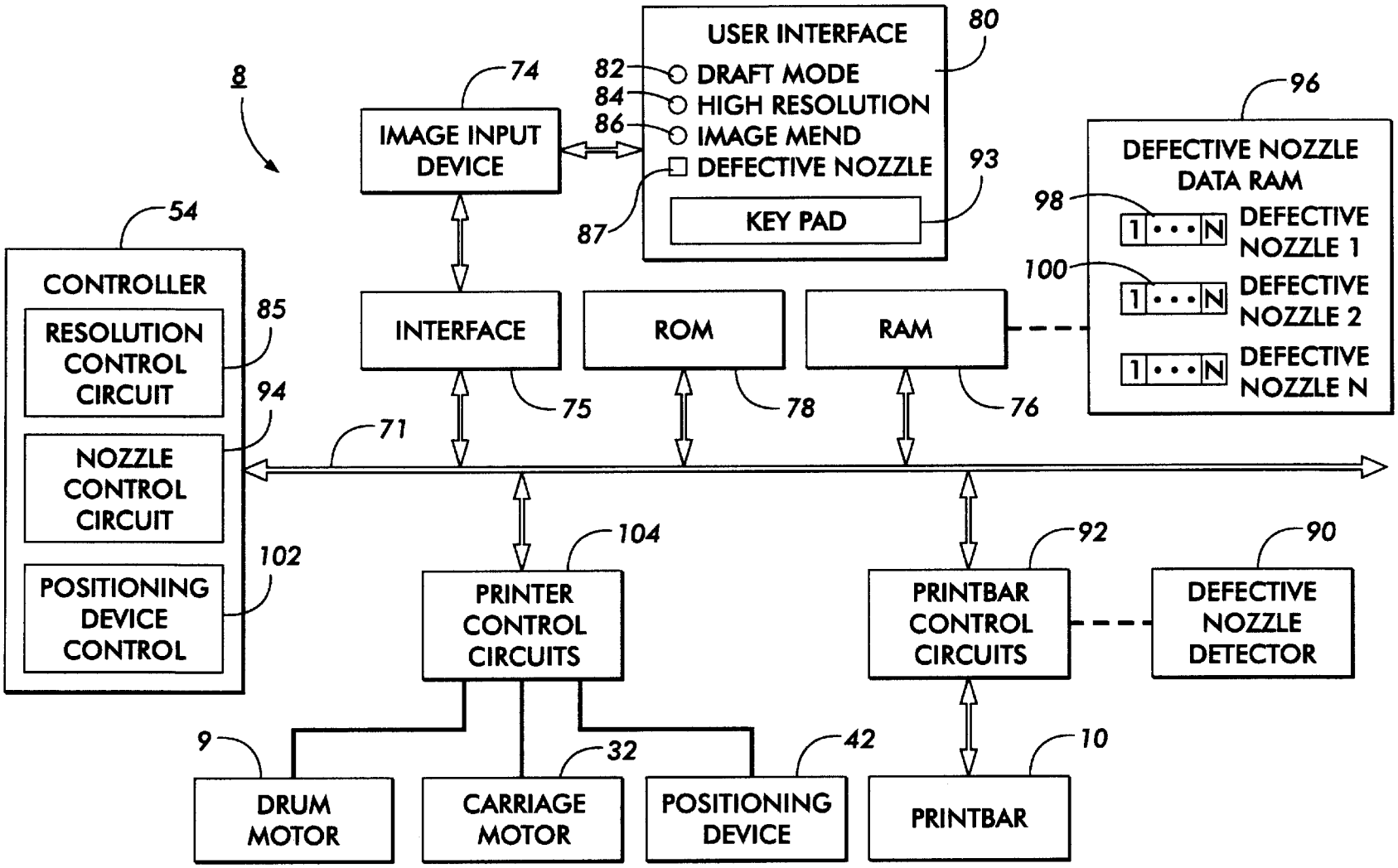
FIG. 5 is a schematic circuit diagram of a control system of the present invention.

FIG. 5 illustrates a printing system, including the printer 8, of the present invention which not only provides for determination of a missing nozzle but which also provides the user with a capability to select whether or not continued printing is desired in light of the defective nozzle. As illustrated in FIG. 5, the controller 54 of the present invention is coupled to a bus 71 for transmission of image information and/or control signals between a plurality of printer devices and an image input device 74. The image input device 74 includes a number of known image generators which generate image information in the form of various image description languages such as the known Page Description Language (PDL) and Postscript. The image input device could, for instance, include a personal computer, a computer workstation, a computer coupled to a scanner, or other known image input devices. The input image device 74 is coupled through a connecting bus to an interface 75 of the printer which provides for a compatible interchange of the image information generated by the image input device to the printer. The interface 75 is connected to the bus 71 and transmits image data and control data to the controller or to a Random Access Memory (RAM) 76 under the direction of the controller 54. The printer, in addition, includes a Read Only Memory (ROM) 78 which includes sufficient memory for the storage of pre-determined operating system or controlling programs such as is known by those skilled in the art. The controller 54 includes a plurality of circuits which enable the printer 8 to fill in missing data on a printed page which occurs because of one or more defective nozzles.

When a defective nozzle is discovered, the user considers whether or not to continue printing. The invention, therefore, includes a user interface 80, which typically appears on a display device, for instance, a cathode ray tube or liquid crystal display of the image input device 74. The user interface includes the selection of two or more document resolutions. For instance, the user interface 80 includes a draft mode selector 82 and a high resolution mode selector 84 which once selected are transmitted to a resolution control circuit 85. In addition, the user interface includes an image mend selector 86 which enables the user to select the option of filling in the missing data on a printed page due to a defective nozzle. Selectors can include pushbuttons, touch sensitive screens, or mouse selectable items in menus. If the user does not select the image mend selector 86, then the user can either decide not to print with the printer until the defective nozzle is corrected or the user can continue to print in the draft mode selection where the nozzle defect may be unobjectionable due to the nature of the printed output image in the draft mode. It also possible to include a defective nozzle visual indicator 87 in the user interface. The indicator 87 indicates to the user that one or more defective nozzles are present and that the user can select image mend 86. In addition, the printing system may include a default setting where once a defective nozzle is identified the system may default to the image mend mode until otherwise changed by the user.

If the user selects the image mend selector 86, then a signal responsive thereto is transmitted from the image input device 74 over the bus 71 to the controller 54. Once the image mend selector 86 has been selected, a defective nozzle detector 90 identifies which of the nozzles are defective. The defective nozzle detector 90 is incorporated as part of print bar control circuits 92 which are coupled to the print bar 10. In one example of a defective nozzle detector, the defective nozzle detector circuit detects when there is no current being carried by a particular drop ejector, which would indicate, for instance, an open heater or thermal transducer. It is also possible that other defective nozzle detection devices including ink sensing conductors placed within a channel. In addition, a print of a diagnostic test pattern could be made. The test pattern would allow the user to identify to the machine which of the nozzles are non-functioning. For instance, if the printer does not include nozzle detectors, the printbar could print a test pattern including nozzle identifiers, such as a number, which is printed by each of the functioning nozzles and which identifies a nozzle. The printer might print a test pattern responsive to a user selecting the image mend selector 86. The missing number or numbers would indicate to the user which of the nozzles is non-functioning. The user would then input the nozzle number or numbers into the printer controller through, a user input device, such as a keypad 93, of the user interface 80.

Once the defective nozzle or nozzles has been identified, the information is accessed by the controller 54 and is used by a nozzle control circuit 94. The nozzle control circuit 94 provides a plurality of functions which includes enabling the storage of the identity of one or more defective nozzles as well as the direction of the storage of image data corresponding to a defective nozzle in a defective nozzle data RAM 96 which can be included in the RAM 76 or which can be separately embodied. The nozzle control circuit 94, upon receipt of the identity of the defective nozzle would cause the defective data RAM to store appropriate data which can not be printed during printing of the image due to the defective nozzle. For instance, if there are two defective nozzles, then the image data which is not printed by the first defective nozzle is stored in a plurality of registers 98. This data, for example, corresponds to a single column of information, such as column 72 of FIG. 3, wherein the image data for every pixel location of the column is stored for each of the lines of the missing column of the printed image. The second defective nozzle data is stored in a register 100.

Once an image has been completed, except for the image data which has been stored in the nozzle data RAM 96, the controller 54 and the nozzle control circuit 94 transmits the stored image data from the RAM 96 to another pre-selected nozzle for printing. The pre-selected nozzle could be determined as a function of the moving capabilities provided by the positioning device 42 or may be selected as a function of a distance measured in nozzle spacing from the defective nozzles. For instance, if a single nozzle is determined to be defective, the printhead may be moved by a distance of sixteen nozzles under control of the positioning device control circuit 102 of the controller 54. The positioning device control circuit 102 transmits a signal representative of the sixteen nozzle spacing or the movement thereof to a printer control circuit 104 which is coupled to the positioning device 42. Since most defective nozzles appear to be random and entail less than 1% of all the possible nozzles in a print bar as described, the probability that another defective pixel column will be subsequently aligned to a second defective nozzle is very small. It is also possible that a known functional nozzle may be selected to print the data. After the positioning device control circuit 102 has transmitted a signal over the bus 71 to cause the positioning device 42 to move sixteen pixels from the defective nozzle, the controller 54 retrieves the defective nozzle data from the RAM 96 such that the data is printed during one or more additional revolutions of the drum under control of the drum motor 9. At the additional cost of one or two extra revolutions of the drum, a printed image is completed with no missing image information.

While the various described circuits 85, 94, and 102 have been identified as part of the controller 54, these circuits can be separate from the controller. In addition, the controller 54 as well as the described circuits 85, 94, and 102 can be embodied as hardware, software, or firmware. It is well known and commonplace to program and execute imaging, printing, document, and/or paper handling control functions and logic with software instructions for conventional or general purpose microprocessors. This is taught by various prior patents and commercial products. Such programming or software may of course vary depending on the particular functions, software type, and microprocessor or other computer system utilized, but will be available to, or readily programmable without undue experimentation from, functional descriptions, such as those provided herein, or prior knowledge of functions which are conventional, together with general knowledge in the software and computer arts. That can include object oriented software development environments, such as C++. Alternatively, the disclosed system or method may be implemented partially or fully in hardware, using standard logic circuits or a single chip using VLSI designs.

While this invention has been described in conjunction with a specific embodiment thereof, in an ink jet environment, it is evident that many alternatives, modifications, and variations will be apparent to those skilled in the art. For instance, the present invention is not limited to the embodiments shown, but is applicable to any type of liquid ink printer having a pagewidth print bar. For instance in one practical embodiment of the present invention, the printhead could include roofshooter type of printhead dies, as well as piezolelectric, wax based, and thermal. In addition, the present invention while being described with regards to a rotating drum configuration, is also applicable to a belt type of transport system. Accordingly, it is intended to embrace all such alternatives, modifications and variations that fall within the spirit and broad scope of the appended claims.

What is claimed is:

1. A liquid ink printer for depositing ink drops to form an image responsive to image data on a recording medium moving along a recording medium path, comprising:

a positionable pagewidth printbar, including an array of ink ejecting nozzles, aligned with and movable in a direction substantially perpendicular to the recording medium path, the printbar ejecting the ink drops on the recording medium during movement of the recording medium along the recording medium path and past said printhead, while the printbar is stationary;

a nozzle identification circuit, coupled to said printbar, to generate a detection signal identifying a non-functioning nozzle of said array of ink ejecting nozzles;

a positioning device, coupled to said pagewidth printbar, to position said printbar at a selected one of a plurality of discrete locations along said direction which is substantially perpendicular to the recording medium path; and a controller comprising a nozzle control circuit to receive said detection signal and to generate in response thereto a control signal to identify image data corresponding to said identified non-functioning nozzle, said controller coupled to said positioning device and to said nozzle identification circuit to cause said positioning device to change position of said printbar to a different one of said plurality of discrete locations as a function of said detection signal, after said recording medium has completed movement past said printbar, whereupon said controller causes said recording medium to move along said recording medium path and past said printbar again, so that the printbar may deposit ink drops from a selected functioning nozzle, on the recording medium corresponding to the identified image data not printed by said identified non-functioning nozzle.

2. The liquid ink printer of claim 1, further comprising a user interface, coupled to said printer, including an image mend selector, to direct the liquid ink printer to print said identified image data corresponding to said non-functioning nozzle.

3. The liquid ink printer of claim 2, further comprising a non-functioning-nozzle data memory, coupled to said controller, to store said identified image data responsive to said control signal.

4. The liquid ink printer of claim 3, wherein said controller comprises a positioning device control circuit, to receive said detection signal and to generate in response thereto a positioning device signal to direct said positioning device to move said printer to one of said plurality of discrete locations.

5. The liquid ink printer of claim 4, wherein said positioning device signal comprises a distance signal to position said printbar a pre-determined distance from said non-functioning nozzle.

6. The liquid ink printer of claim 5, wherein said predetermined distance is equivalent to a pre-selected number of nozzles.

7. The liquid ink printer of claim 6, wherein said preselected number of nozzles is sixteen.

8. The liquid ink printer of claim 5, wherein said predetermined distance is selected as a function of one of said plurality of discrete locations.

9. The liquid ink printer of claim 1, wherein said nozzle identification circuit comprises a nozzle detection circuit coupled to said plurality of nozzles to generate a signal indicating which of said nozzles are non-functioning.

10. The liquid ink printer of claim 1, wherein said nozzle identification circuit comprises a user input device, to receive a nozzle identifier supplied by a user.

11. A method for printing an image, with a pagewidth printbar, including one or more non-functioning nozzles and a plurality of functioning nozzles depositing liquid ink on a recording medium moving along a path, comprising the steps of:

identifying one of the plurality of nozzles which is non-functioning;

printing a portion of the image with the plurality of functioning nozzles with the printbar located at a first position;

moving the printbar substantially perpendicular to the path to a second position; and printing another portion of the image with one of the plurality of functioning nozzles.

12. The method of claim 11, wherein said identifying step comprises identifying one of the plurality of nozzles which is non-functioning by electrically sensing the non-functioning nozzle.

13. The method of claim 11, wherein said identifying step comprises identifying one of the plurality of nozzles which is non-functioning by printing a diagnostic test pattern on the recording medium.

14. The method of claim 11, wherein said first mentioned printing step comprises printing a portion of the image by moving the recording medium past the printbar a first time.

15. The method of claim 14, wherein said second mentioned printing step comprises printing a portion of the image by moving the recording medium past the printbar a second time.

16. The method of claim 15, wherein said first mentioned printing step comprises printing a portion of the image by moving the recording medium with a rotating drum.

* * * * *